US011220014B2

(12) United States Patent
Kim et al.

(10) Patent No.: US 11,220,014 B2
(45) Date of Patent: Jan. 11, 2022

(54) RAZOR CARTRIDGE

(71) Applicant: DORCO CO., LTD., Seoul (KR)

(72) Inventors: Dong Il Kim, Seoul (KR); Sung Hoon Oh, Seoul (KR)

(73) Assignee: DORCO CO., LTD., Seoul (KR)

( * ) Notice: Subject to any disclaimer, the term of this patent is extended or adjusted under 35 U.S.C. 154(b) by 0 days.

(21) Appl. No.: 16/503,220

(22) Filed: Jul. 3, 2019

(65) Prior Publication Data

US 2020/0031005 A1 Jan. 30, 2020

(30) Foreign Application Priority Data

Jul. 27, 2018 (KR) ..... 10-2018-0087847

(51) Int. Cl.
*B26B 21/40* (2006.01)
*B26B 21/22* (2006.01)
*B26B 21/56* (2006.01)

(52) U.S. Cl.
CPC ..... *B26B 21/4031* (2013.01); *B26B 21/225* (2013.01); *B26B 21/56* (2013.01)

(58) Field of Classification Search
CPC ... B26B 21/4031; B26B 21/225; B26B 21/56; B26B 21/00; B26B 21/22; B26B 21/222; B26B 21/227; B26B 21/4012
USPC ..... 30/50, 32, 34.2, 40, 51
See application file for complete search history.

(56) References Cited

U.S. PATENT DOCUMENTS 5,687,485 A 11/1997 Shurtleff et al.
5,761,814 A 6/1998 Anderson et al.
5,956,848 A 9/1999 Tseng et al.
5,956,851 A 9/1999 Apprille et al.
6,041,926 A 3/2000 Petricca et al.
6,052,903 A 4/2000 Metcalf et al.
6,185,822 B1 2/2001 Tseng et al.
6,212,777 B1 4/2001 Gilder et al.
6,266,884 B1 * 7/2001 Prochaska ..... B26B 21/222 30/346.57
6,442,839 B1 9/2002 Tseng et al.
(Continued)

FOREIGN PATENT DOCUMENTS

WO 2012061343 5/2012

OTHER PUBLICATIONS

European Patent Office Application Serial No. 19188287.7, Search Report dated Nov. 26, 2019, 8 pages.

*Primary Examiner* — Phong H Nguyen

(74) *Attorney, Agent, or Firm* — Lee, Hong, Degerman, Kang & Waimey PC

(57) ABSTRACT

A razor cartridge includes: a blade housing accommodating a plurality of blades including at least a first blade and a second blade; a first contact member arranged at a front side of the plurality of blades with respect to a shaving direction; and a second contact member arranged at a rear side of the plurality of blades with respect to the shaving direction, each blade including an edge portion and a base, wherein a thickness of a first position of the edge portion of the first blade is less than a thickness of a corresponding second position of the edge portion of the second blade, and wherein a first exposure amount of the first blade with respect to a contact plane defined between the first contact member and the second contact member is less than a second exposure amount of the second blade with respect to the contact plane.

19 Claims, 11 Drawing Sheets

(56) References Cited

U.S. PATENT DOCUMENTS

| | | | | |
|---|---|---|---|---|
| 6,516,518 | B1 | 2/2003 | Garraway et al. | |
| 6,612,040 | B2 | 9/2003 | Gilder | |
| 6,655,030 | B2 * | 12/2003 | Zuidervaart | B26B 21/22 30/346.5 |
| 6,684,513 | B1 | 2/2004 | Clipstone et al. | |
| 2010/0011588 | A1 * | 1/2010 | Wang | B26B 21/4031 30/41 |
| 2010/0011595 | A1 * | 1/2010 | Claus | B26B 21/60 30/346.54 |
| 2011/0146079 | A1 | 6/2011 | Clarke et al. | |
| 2014/0026424 | A1 | 1/2014 | Oglesby et al. | |
| 2015/0013169 | A1 | 1/2015 | Warrick | |
| 2016/0121499 | A1 * | 5/2016 | Yoo | B26B 21/56 30/50 |

* cited by examiner

RAZOR CARTRIDGE

CROSS-REFERENCE TO RELATED APPLICATION

Pursuant to 35 U.S.C. § 119(a), this application claims the benefit of earlier filing date and right of priority to Korean Patent Application No. 10-2018-0087847, filed on Jul. 27, 2018, the contents of which are hereby incorporated by reference herein in its entirety.

BACKGROUND OF THE INVENTION

1. Field of the Invention

The present invention relates to a razor cartridge; and more particularly to an arrangement of razor blades mounted in the razor cartridge.

2. Description of the Related Art

A typical razor, commonly known as a wet razor, includes a razor cartridge and a razor handle. Since the razor cartridge is detachable from the razor handle, the user can replace the razor cartridge as needed. Also, in the razor cartridge, a plurality of blades are arranged in a shaving direction.

The shapes and dimensions of these razor blades greatly influence the quality of shaving. Generally, the razor blade has a continuously tapered shape that converges toward an ultimate tip. A portion of the blade that includes the ultimate tip is called a tip edge. Although a thick and strong tip edge would result in less wear and longer life, it may result in shaving discomfort by causing increase of cutting force (cutting resistance) and tugging and pulling phenomenon. In contrast, thinning of the tip edge profile may result in decrease of cutting force required for shaving while it may also result in increase the possibility of breakage or damage of the blade or the possibility of skin cut, shortening durability of the blade. Accordingly, it is necessary to form an appropriate cutting edge in the razor blade to provide optimum cutting force, shaving comfort, and durability.

Not only the shape and thickness, but also the arrangement of the razor blade greatly influence the quality of shaving. As factors related to the arrangement of the blade, exposure of the blade and the span of the blade may be considered first. In particular, it is desirable that the exposure of the blade be designed to provide clean yet excellent shaving comfort and to minimize nicks and cuts. In general, the exposure of a razor blade refers to a relative value indicating the position of the ultimate tip of the razor blade outwardly exposed with respect to a contact plane defined by connecting the upper end of a first contact member located in front of the blade and the upper end of a second contact member located behind the blade.

Thus, the razor blade may have a neutral position, or an exposure amount of zero, in which the ultimate tip of the blade is substantially aligned with the contact plane, a positive position, or a positive exposure amount, in which the tip edge of the blade protrudes past the contact plane, or a negative position, or a negative exposure amount, in which the tip edge of the blade is not in contact with the contact plane, but is offset away from a shaving surface.

Since human skin is deformable and may move through the contact plane, shaving can be performed even with a negative protrusion. Generally, the larger the positive protrusion, it would be easier to provide smoother shaving, although the risk of nicks and cuts would be greater. In a conventional multi-blade razor, different razor blades are positioned with different exposures. As a result, the razor blades tend to contact the skin differently and wear at different rates.

Thus, in order to provide comfort and sufficient shaving performance in shaving, not only the shape and thickness of the razor blade, but also the exposure of the razor blade needs to be considered. In particular, a correlation between the shape or thickness of the blade and the exposure of the blade should be sufficiently considered. However, in the conventional razor cartridge, a factor such as the shape or thickness of the blade and a factor such as the exposure of the blade have been separately considered, and thus, a correlation between the two factors and the influence of the correlation on the shaving comfort or shaving performance have not been fully considered.

SUMMARY OF THE INVENTION

Therefore, the present invention has been made in view of the above problems, and it is an object of the present invention to provide a razor cartridge in which a razor blade is arranged and allowed to have a suitable exposure according to the shape and thickness of the razor blade with a view to improving both shaving comfort and shaving performance.

It is another object of the present invention to derive a preferable correlation among the thickness, arrangement and exposure of each blade in a razor cartridge having both a thin razor blade and a thick razor blade.

It will be appreciated by persons skilled in the art that the objects that can be achieved with the present invention are not limited to what has been particularly described hereinabove and other objects that can be achieved with the present invention will be more clearly understood from the following detailed description.

In accordance with an aspect of the present invention, the above and other objects can be accomplished by the provision of a razor cartridge including a blade housing configured to accommodate a plurality of blades comprising at least a first blade and a second blade; a first contact member arranged at a front side of the plurality of blades with respect to a shaving direction; and a second contact member arranged at a rear side of the plurality of blades with respect to the shaving direction.

Each of the plurality of blades includes an edge portion and a base.

A thickness of a first position of the edge portion of the first blade is less than a thickness of a corresponding second position of the edge portion of the second blade.

A first exposure amount of the first blade with respect to a contact plane defined between the first contact member and the second contact member is less than a second exposure amount of the second blade with respect to the contact plane.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
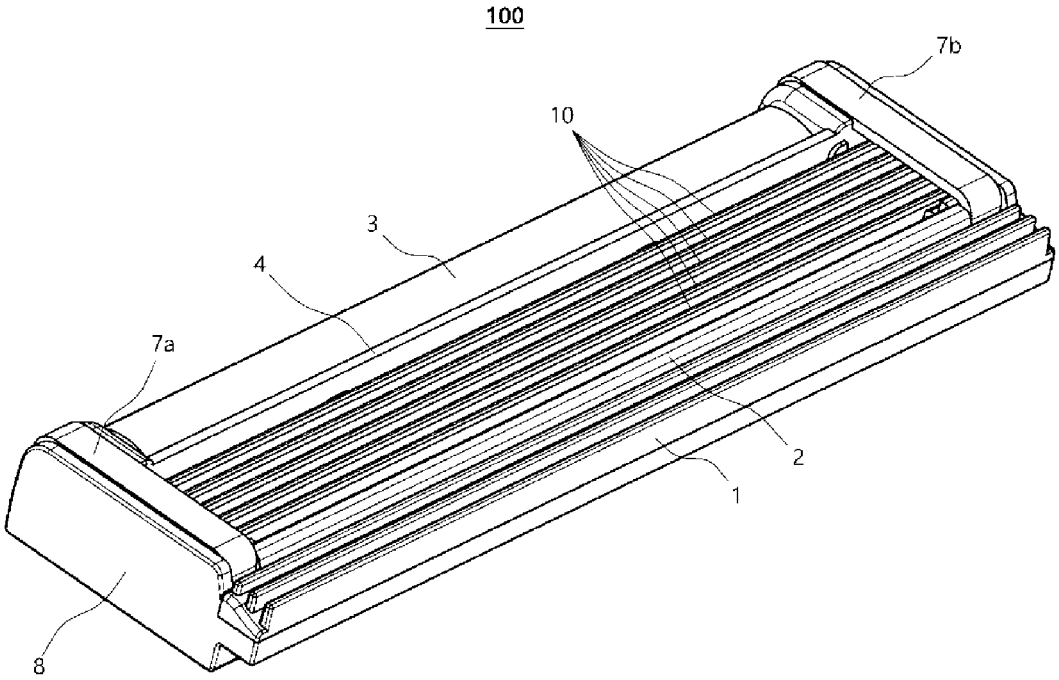
FIG. 1 is a perspective view of a razor cartridge according to an embodiment of the present invention.

The advantages and features of the present invention and the manner of achieving the same will become apparent from the embodiments described in detail below with reference to the accompanying drawings. The present invention may, however, be embodied in many different forms and should not be construed as limited to the embodiments set forth herein. It should be understood that these embodiments are provided such that the disclosure will be thorough and complete, and will fully convey the concept of the invention to those skilled in the art. The scope of the invention is only defined by the claims. Wherever possible, the same reference numerals will be used to refer to the same or like parts.

Unless defined otherwise, all terms (including technical and scientific terms) used in this specification may be construed as having meanings commonly understood by those skilled in the art. Terms defined in typical dictionaries should not be interpreted ideally or excessively.

Terms used in this specification are merely adopted to explain specific embodiments, and are not intended to limit the present invention. A singular expression encompasses a plural expression unless the two expressions are contextually different from each other. In this specification, "comprises" and/or "comprising" does not exclude presence or addition of one or more other elements in addition to the stated element. Hereinafter, an embodiment of the present invention will be described in detail with reference to the accompanying drawings.

FIG. 1 is a perspective view of a razor cartridge 100 according to an embodiment of the present invention.

Each of a plurality of razor blades 10 may have a tip edge at one end thereof, and the other end thereof may be seated in a seating slot provided in a blade housing 8. Here, the plurality of razor blades 10 include one or more blades arranged side by side in a shaving direction. The shaving direction refers to the direction from a front guard 2 to a rear cap 4.

In order to prevent the blades 10 from being separated from the blade housing 8, a pair of fixing clips 7*a* and 7*b* for fixing both side ends of the tip edges of the blades 10 to the blade housing 8 may be provided. The fixing clips 7*a* and 7*b* are bent on the lower surface of the blade housing 8 through the through holes formed near both ends of the blade housing 8 while wrapping around both side ends of the blades 10. According to an embodiment exemplified in FIG. 1, the front legs of the fixing clips 7*a* and 7*b* are arranged through the through holes formed in the vicinity of the front end of the blade housing 8 and the rear legs of the fixing clips 7*a* and 7*b* wrap around the rear end of the blade housing 8. However, the present invention is not limited to this configuration. Both the front and rear ends may be wrapped around, or the legs of the fixing clips may be arranged through the front and rear through holes and be bent on the lower surface.

The plurality of razor blades 10 arranged in the blade housing 8 is partitioned by the front guard 2 and the rear cap 4. An elastic member 1 may be arranged in front of the front guard 2 to be parallel to the blades 10 and a lubrication strip 3 may be arranged at the rear of the cap 4 to be parallel to the blades 10. The elastic member 1 erects the user's hair in a direction substantially perpendicular to the shaving direction to facilitate the cutting operation of the blades 10, and the lubrication strip 3 smooths rough skin after cutting. However, the present invention is not limited thereto.

For example, the lubrication strip 3 may be arranged in front of the front guard 2 to be parallel to the blades 10, and the elastic member 1 may be arranged at the rear of the cap 4 to be parallel to the blades 10. Alternatively, lubrication strips 3 or elastic members 1 may be arranged in front of the front guard 2 and behind the cap 4.

The plurality of blades 10 illustrated in FIG. 1 consist of five blades. However, the number of razor blades arranged in the razor cartridge 100 may be varied by factors such as the shape and thickness of the blades 10, the span, the size of the razor cartridge, the purpose of shaving, and the like. Therefore, more or fewer razor blades 10 may be arranged in the razor cartridge 100. In general, the number of blades adopted in the art is 2 to 7. It is therefore to be understood that the razor cartridge basically includes a front blade adjacent to the front guard 2 and a rear blade adjacent to the cap 4, and may further include additional blades between the front and rear blades.

Figure 2:
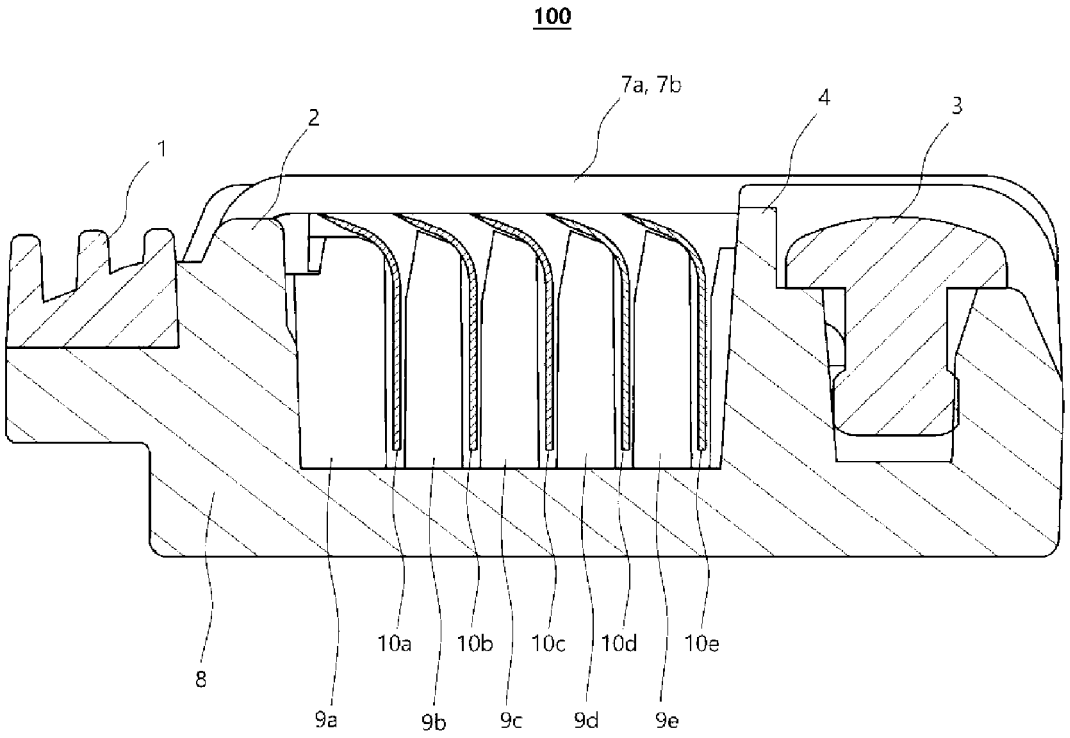
FIG. 2 is a longitudinal sectional view of a central portion of the razor cartridge of FIG. 1, taken in a shaving direction.

FIG. 2 is a longitudinal sectional view of a central portion of the razor cartridge 100 of FIG. 1, taken in a shaving direction. Referring to FIG. 2, five blades 10*a* to 10*e* are inserted in a gap (slot) formed between the seating projections 9*a* to 9*e*. Specifically, a part of the edge portion or the bent portion of the front surface of the blades 10*a* to 10*e* may be supported by a seating projection (for example, the seating projection 9*a* for the blade 10*a*) in front thereof. Further, the bases of the razor blades 10*a* to 10*e* may be supported between two seating projections (for example, the seating projections 9*a* and 9*b* for the blade 10*a*) located on the front and rear sides thereof.

The razor blades 10*a* to 10*e* may be firmly installed in the blade housing 8 by a pair of fixing clips 7*a* and 7*b*, which press the tip edge downward at both side ends thereof, while being supported by the seating projections 9*a* to 9*e* as described above.

A more detailed shape of the blades 10 shown in FIG. 1 or 2 is described below with reference to FIGS. 3A and 3B.

Figure 3A:
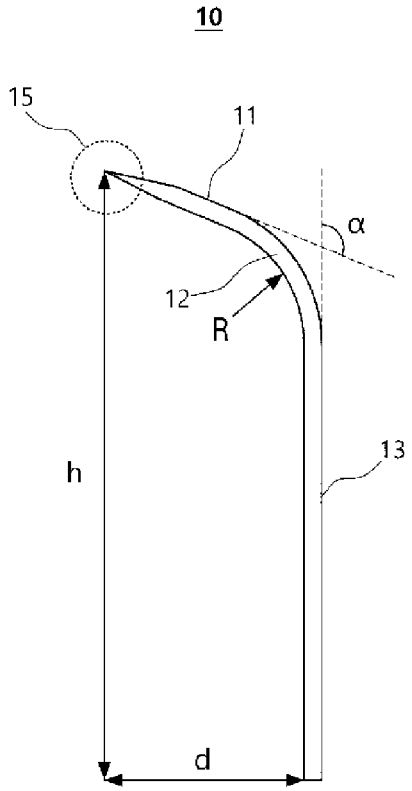
FIGS. 3A and 3B are views showing a more detailed shape of the razor blade shown in FIG. 1 or 2.

FIG. 3A is a side view of an integrated blade according to an embodiment of the present invention. Referring to FIG. 3A, an integrated blade 10 includes a base 13 seated in a slot of the blade housing 8, an edge portion 11 having a tip edge 15 at the front end thereof, and a bent portion 12 bent forward and connecting the base 13 and the edge portion 11. The dimensions of the overall shape of the integrated blade include height h, depth d, radius of curvature R, and bending angle α.

For example, the integrated blade 10 has a height h of 1.5 mm to 5.0 mm, a depth d of 0.7 mm to 3.0 mm, a radius of curvature R of 0.45 mm to 0.9 mm, and a bending angle α of 90° to 170°. The integrated blade 10 may be manufactured in a process of bending a single body and may be designed to be thick or thin as needed. Herein, the edge portion 11 is not present on the extension of the base 13.

Figure 3B:
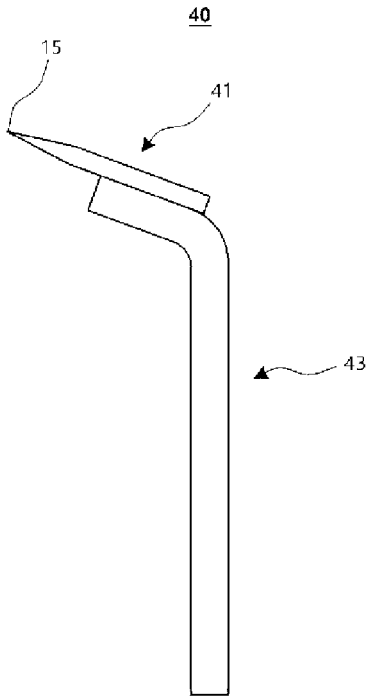

However, the present invention is not limited thereto, and the blade used in the present invention may be a joined blade 40 as shown in FIG. 3B. The joined blade 40 consists of two members including a metal base 43 seated in a slot in the blade housing 8 and an edge portion 41 joined to the metal base 43 and having a tip edge 15. Like the integrated blade 10, the joined blade 40 has a base and a bent portion, and also has a blade attachment portion for supporting and joining the edge portion 41. The metal base 43 of the joined blade 40 is formed thicker than the edge portion 41, and thus, may firmly support the edge portion 41. Here, the edge portion 41 does not lie on the extension of the metal base 43.

In the following description, the blade according to an embodiment of the present invention is assumed to be the integrated blade 10 as shown in FIG. 3A. However, the present invention is not limited thereto. The present invention does not exclude a case where the blade is the joined blade 40 shown in FIG. 3B, a straight blade, or a blade having other shapes. However, using the integrated blade 10 or the joined blade 40 may be more appropriate than using the straight blade because the angle formed by the integrated blade 10 or the joined blade 40 with the skin is more favorable to shaving and less irritating to the skin.

Figure 4:
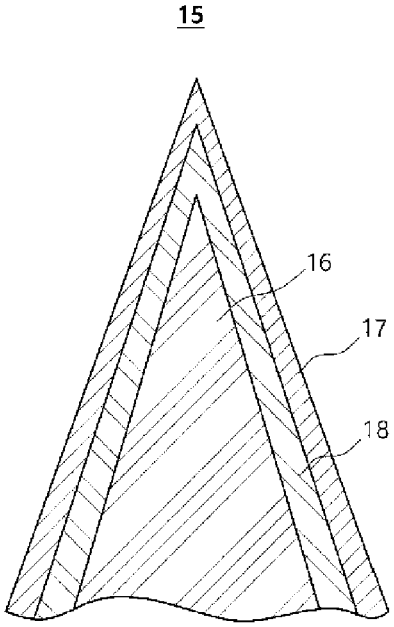
FIG. 4 is a longitudinal sectional view of a tip edge formed on a razor blade according to an embodiment of the present invention.

FIG. 4 is a longitudinal sectional view of a tip edge 15 formed on a razor blade 10 or 40 according to an embodiment of the present invention. The tip edge 15 may include a substrate 16, an intermediate coating layer 18, and an outer coating layer 17, which are arranged from the innermost side in order. The substrate 16 is typically made of stainless steel, but other materials may be used. Further, a hard coating layer may be further provided on the outer surface of the substrate to increase the strength and corrosion resistance of the substrate 16. The hard coating layer may be formed of a carbon-containing material such as DLC (Diamond Like Carbon), a nitride, an oxide, or a ceramic material.

The intermediate coating layer 18 formed between the substrate 16 and the outer coating layer 17 is used to increase the strength of the blades 10 and 40 or to promote adhesion of the outer coating layer 17 to the substrate 16. The intermediate coating layer 18 may be formed using a carbon-containing material such as DLC, a nitride, an oxide, a ceramic, or a chromium-containing material.

Lastly, the outer coating layer 17 is formed on the outer surface of the tip edge 15 to reduce friction. The outer coating layer 17 may be formed using a polyfluorocarbon, such as polytetrafluoroethylene (PTFE), as a polymer composition. Typically, PTFE acts as a nonflammable and stable dry lubricant composed of small particles that stably disperse.

Figure 5:
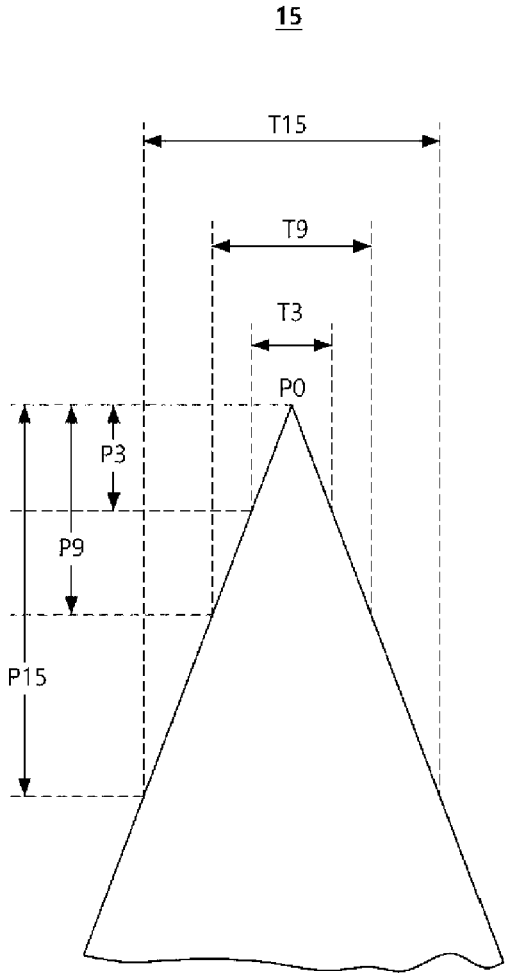
FIG. 5 is a view showing a thickness dimension of the tip edge shown in FIG. 4 at respective positions.

FIG. 5 is a view showing a thickness dimension of the tip edge 15 shown in FIG. 4 at respective positions. As shown in FIG. 5, the ultimate tip position of the tip edge 15 may be denoted by P0, and the point at which the distance (i) from the origin in the longitudinal direction is expressed in micrometers (μm) may be denoted by Pi. Thus, in FIG. 5, P3, P9, an P15 indicate positions 3 μm, 9 μm, and 15 μm apart from the origin in the longitudinal direction, respectively. The thickness at each of these positions is defined in a transverse dimension of the tip edge 15. For example, T15 means the transverse dimension (thickness) of the tip edge 15 at the position of P15.

Since the properties such as shaving performance and strength of the blade are generally influenced greatly by the thickness profile of the tip edge 15, the properties of the desired blade may be determined by designing various thickness profiles.

According to an embodiment of the present invention, a relatively thin blade and a relatively thick blade may be arranged together in the blade housing 8. Here, the thin blade refers to a razor blade that has a relatively small thickness dimension at overall positions on the tip edge 15 and is thin and sharp as a whole while having low cutting force (cutting resistance) and low durability. Similarly, the thick blade refers to a blade that has a relatively large thickness dimension at overall positions on the tip edge 15 and is thick and less sharp as a whole while having high cutting force (cutting resistance) and high durability.

Preferably, the thickness profile of the tip edge for each of the thin blade and the thick blade may be designed as shown in Table 1 below.

TABLE 1

| | Thick blade | Thin blade |
|---|---|---|
| T3 | 1.2-1.6 μm | 1.0-1.5 μm |
| T9 | 3.6-4.4 μm | 3.0-3.8 μm |
| T15 | 5.7-6.7 μm | 4.7-5.7 μm |

As shown in Table 1, the thick blade has a greater thickness at the overall positions on the tip edge 15 (approximately above P1) than the thin blade.

The profiles of the thick blade and the thin blade may be defined with a thickness dimension at the position of Pi, but the important positions affecting change in the overall properties of the blade according to the thickness of the tip edge are identified as approximately P3, P9 and P15. Thus, by designing the thicknesses at these positions differently, thick and thin razor blades having various dimensions can be produced.

Such profile of a blade has a direct influence on cutting force. For example, in Table 1, the thin blade has Shaving Hair Cutting Force (SHCF)(%) lower than SHCF of the thick blade by a value of 5% or more, specifically about 9.36%. The SHCF is an index for evaluating the cutting force and indicates a relative value obtained by evaluating the force (gf) applied in cutting a hair strand. Therefore, SHCF is proportional to cutting force, and thus, the lower the cutting force, the better the cutting performance is. In general, SHCF is indicated by '−' when the cutting force is relatively small, and indicated by '+' when the cutting force is relatively large. When the difference in SHCF is −5% or lower, it is determined that shaving performance has been improved.

As such, the shape and thickness of the thin blade and the thick blade arranged in the razor cartridge 100 primarily affect shaving performance. The manner in which individual blades are arranged with respect to the contact plane of the razor cartridge 100, namely, the design of the exposure, also greatly affects shaving performance. In particular, it is important to adaptively select suitable exposures considering the characteristics of the blades.

Figure 6:
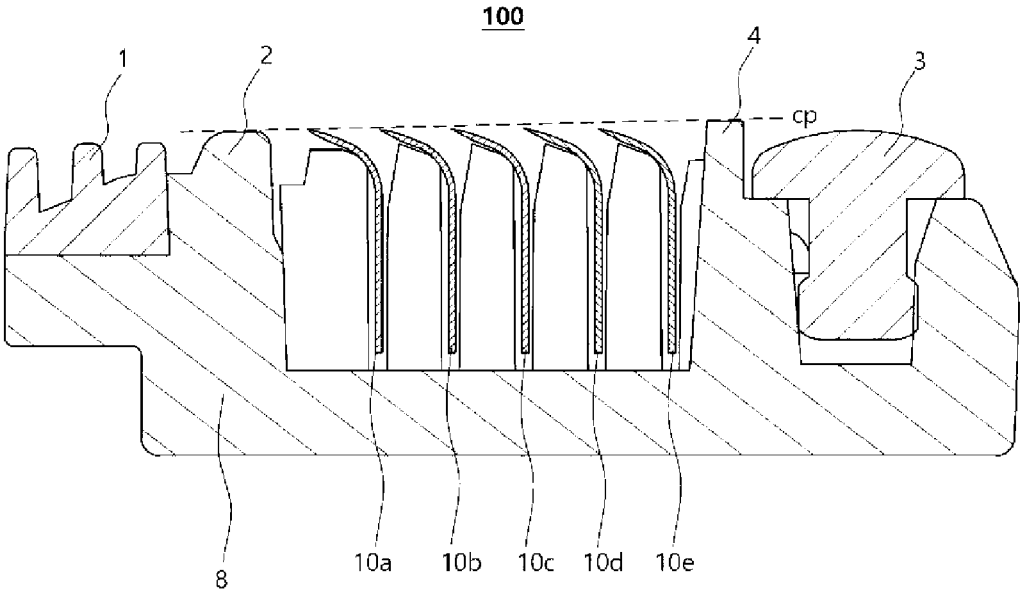
FIG. 6 is a view illustrating a relative relationship between a tip edge of a razor blade and a contact plane, which is shown by removing fixing clips from the razor cartridge of FIG. 2.

FIG. 6 is a view illustrating a relative relationship between the tip edge of a razor blade and the contact plane cp, which is shown by removing fixing clips 7*a* and 7*b* from the razor cartridge of FIG. 2.

This contact plane cp is a virtual plane defined by connecting the upper end of a first contact member located in front of the blades 10*a* to 10*e* and the upper end of a second contact member located behind the blades 10*a* to 10*e*. The contact plane cp is shown as a line in a cross-sectional view of FIG. 6. The exposure of a blade is a relative value indicating the position of the tip edge or ultimate tip of the blade with respect to the contact plane, and may be divided into three types, i.e., positive, neutral and negative.

In the embodiment of FIG. 6, the first contact member is the front guard 2 and the second contact member is the rear cap 4. However, embodiments are not limited thereto. When the front guard 2 is formed at a lower position, the first contact member may be the elastic member 1. When the cap 4 is formed at a lower position, the second contact member may be the lubrication strip 3. In other words, the positions of the front and rear contact points in the contact plane may depend on the structure of the razor cartridge, but even in this case the contact plane is defined in the same manner as it is defined by connecting the uppermost point in front of the razor blade and the uppermost point behind the razor blade.

The razor blades 10*a* to 10*e* arranged in FIG. 6 include at least one thin blade and/or at least one thick blade. For example, the foremost blade 10*a* may be a thin blade and the rearmost blade 10*e* may be a thick blade. Since the foremost blade 10*a* is first brought into contact with the hairs in shaving, a thin razor blade having a low cutting force is arranged as the foremost blade. Since the rearmost blade 10*e* is the last blade that is brought into contact with the hairs, a thick blade having a high cutting force is arranged as the rearmost blade. The cutting force is conceptually the same as frictional resistance, such as SHCF described above, used in cutting hairs. However, the above-described arrangement is merely an embodiment of the present invention, and any other arrangement is also possible.

In the present invention, the thick blade and the thin blade may be defined according to Table 1 above, but in other embodiments, the "thick" and "thin" designations may be relative to each other as the thick blade and the thin blade may both included in a single reference range of Table 1, for example in a single range of a thick blade of T15. Thus for example, T15 for the thin blade may be in the range of 5.2±0.5 μm, and T15 for the thick blade may be in the range of 6.2±0.5 μm. Thus, the thickness ratio of the thick blade to the thin blade based on T15 is approximately 1.0 to 1.5, preferably 1.15 to 1.5.

The reason for using T15 as a reference is that the cutting force and durability of the blade are most influenced by the value of T15 and the portions below P15 on the tip edge 15 are most involved in cutting.

Here, the exposure with respect to the contact plane of the thick blade may be larger than the exposure of the thin blade. In general, as the tip edge becomes thinner, the cutting force (the cutting resistance) is lowered, causing skin irritation. Therefore, it is necessary to reduce skin irritation while making the cutting work easier by relatively reducing the exposure relative to the contact plane. In addition, if the tip edge is thick, it may have high durability, and thus, may withstand a larger load. Accordingly, durability of the razor cartridge may be increased by relatively increasing the exposure.

More preferably, the blades may be designed such that the thick blade has a positive exposure and the thin blade has a negative exposure based on the neutral exposure. Here, the lower limit of the exposures of these two types of razor blades may be limited to −0.1 mm and the upper limit may be limited to +0.1 mm.

As such, the design of the razor cartridge considering both the thickness and the exposure of the razor blades at the same time contributes to ensuring sufficient shaving performance while minimizing skin irritation, as well as to improving the durability and lifespan of the entire razor cartridge.

The numerical relationships discussed above may be summarized as Equations 1 to 3. First, Equation 1 represents the relationship between the thicknesses of the thick blade and the thin blade at position P15. As discussed above, "thick" and "thin" may be defined by the values given in Table 1, but other embodiments are considered in which these terms are relative to each other, and both fall within a single range given by either the "Thick blade" or the "Thin blade" of Table 1. This equation is determined only by the shape of the blades regardless of the exposure.

$$T15_B=(\alpha+1)*T15_A, 0.1<\alpha<0.5 \quad \text{Equation 1}$$

Here, $T15_A$ denotes T15 of the thin blade and $T15_B$ denotes T15 of the thick blade.

Further, the relationship between the thickness and the exposure at position P15 for each of the thick blade and the thin blade may be represented as Equation 2. That is, Equation 2 represents how the respective exposures should be related to each T15, without distinguishing between the thick blade and the thin blade. According to Equation 2, as the exposure increases from a negative value to a positive value, T15 should be increased.

$$T15=10\times+5.7,\ x=SSP \quad \text{Equation 2}$$

Here, T15 denotes T15 (μm) of the thick blade or the thin blade, and SSP denotes the exposure value (mm) of each blade. However, considering the range suitable for the actual shaving performance, SSP has a margin of ±10%. That is, x may have a range of 0.9*SSP to 1.1*SSP. However, due to an error in the blade manufacturing process, the value of T15 of an actual product may not always satisfy Equation 2 and may have a value close to Equation 2.

The relationship between the thickness ratio of the thick blade to the thin blade and the exposure at position P15 may be expressed as Equation 3. Equation 3 represents a correlation between the magnitude of the exposure and the thickness ratio between the two blades (thickness ratio at position P15).

$$1.03\leq T15_B/T15_A\leq 4y+1.03,\ y=SSP2 \quad \text{Equation 3}$$

Here, SSP2 denotes a larger value (mm) of the magnitude (absolute value) of the exposure of the thick blade and the magnitude (absolute value) of the exposure of the thin blade. Of course, it may be possible to make the two exposures have the same magnitude by designing the exposures of the two blades to be symmetrical with respect to the contact plane. However, in the case of exposures having different magnitudes, an exposure having a greater magnitude may have a higher correlation with such thickness ratio. Here, in consideration of a range suitable for actual shaving performance, SSP2 also has a margin of ±10%. Thus, y may have a range of 0.9*SSP2 to 1.1*SSP2.

Various embodiments relating to blade arrangement, taking into account the correlation between the thickness and the exposure of the blades as described above, are shown in FIGS. 7 to 12. As described above, the thin blade may be defined as a blade with T15 of 5.2±0.5 μm, and the thick blade may be defined as a blade with T15 of 6.2±0.5 μm.

Figure 7:
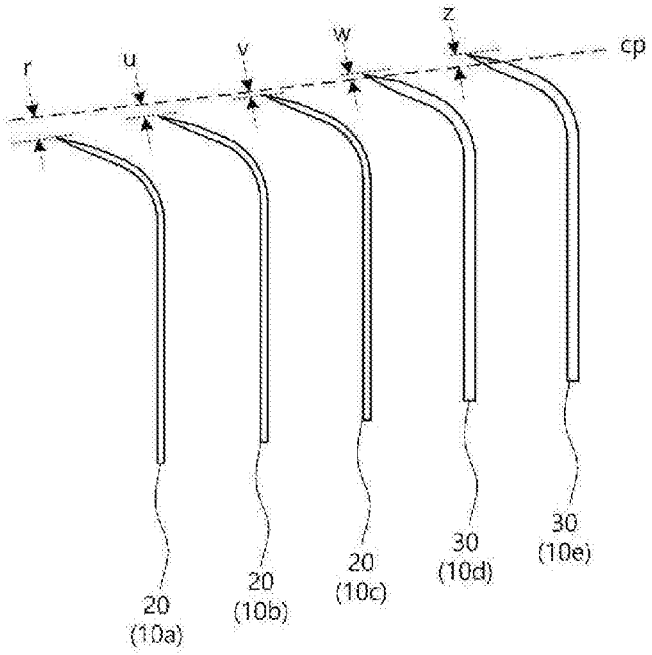
FIG. 7 is a view showing an embodiment in which exposure with respect to a contact plane gradually increases among blades.

Among the figures, FIG. 7 is a view showing an embodiment in which the exposure with respect to the contact plane cp gradually increases among the blades. Referring to FIG. 7, the exposures r to z of the blades 10*a* to 10*e* from the front to back of the razor cartridge gradually increase with respect to the contact plane cp.

In this arrangement, thin blades arranged at the front of the razor cartridge may allow for adequate shaving with low cutting resistance while reducing skin irritation, and thick blades arranged behind may ensure sufficient support stiffness and durability. In particular, shallow shaving is performed by the front blades, followed by deep shaving by the rear blades. Thereby, a balanced shaving stroke may be provided.

While FIG. 7 illustrates that three identical thin blades 20 are arranged at the front and two thick blades 30 are arranged at the rear, the present invention is not limited thereto. Five different razor blades may be arranged such that the thickness thereof gradually increases from the front to the back.

Figure 8:
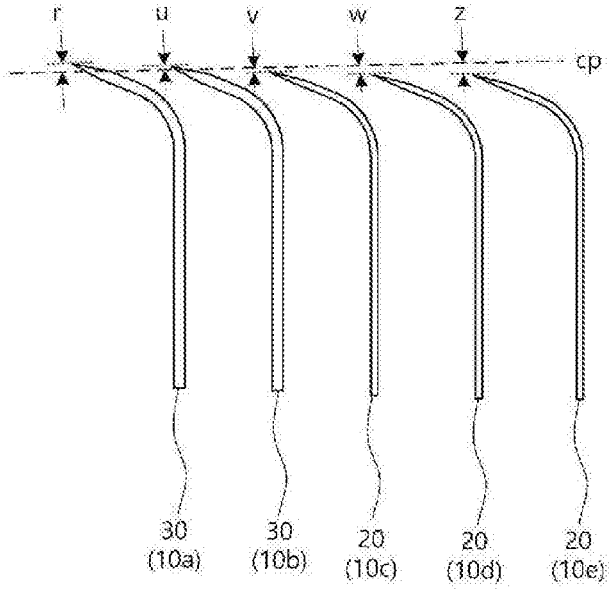
FIG. 8 is a view showing an embodiment in which exposure with respect to a contact plane gradually decreases among blades.

Next, FIG. 8 is a view showing an embodiment in which the exposure with respect to the contact plane cp gradually decreases among the blades. Referring to FIG. 8, the exposures (r to z) of the blades 10*a* to 10*e* with respect to the contact plane cp gradually decrease from the front to back of the razor cartridge.

In this arrangement, the blades arranged at the front of the razor cartridge may ensure sufficient support stiffness and durability, and the blades arranged behind may provide proper shaving with low cutting resistance while reducing skin irritation. Particularly, the front blades may perform shaving with high cutting force, and then the rear blades may finish shaving, making the skin clean and smooth.

While FIG. 8 illustrates that two identical thick blades 30 are arranged at the front and three thin blades 20 are arranged at the rear, the present invention is not limited thereto. For example, five different razor blades may be arranged such that the thickness thereof gradually decreases from the front to the back.

Figure 9:
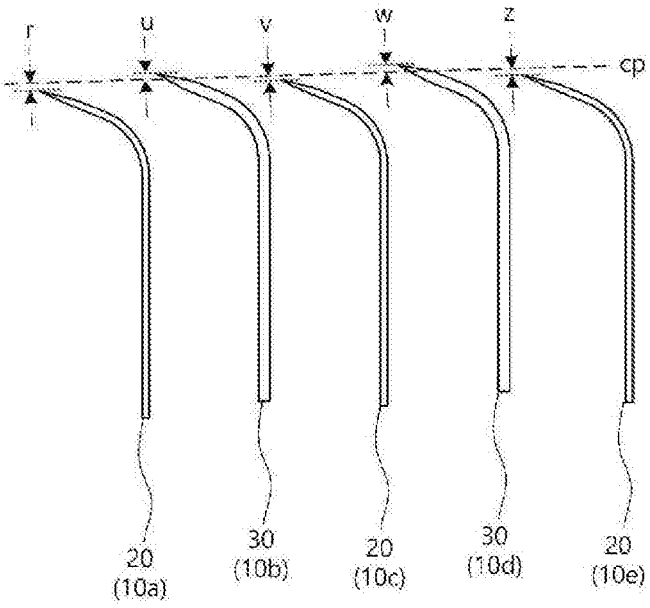
FIGS. 9 and 10 are views showing an embodiment in which exposures of blades are formed in a zigzag pattern with respect to a contact plane.
Figure 10:
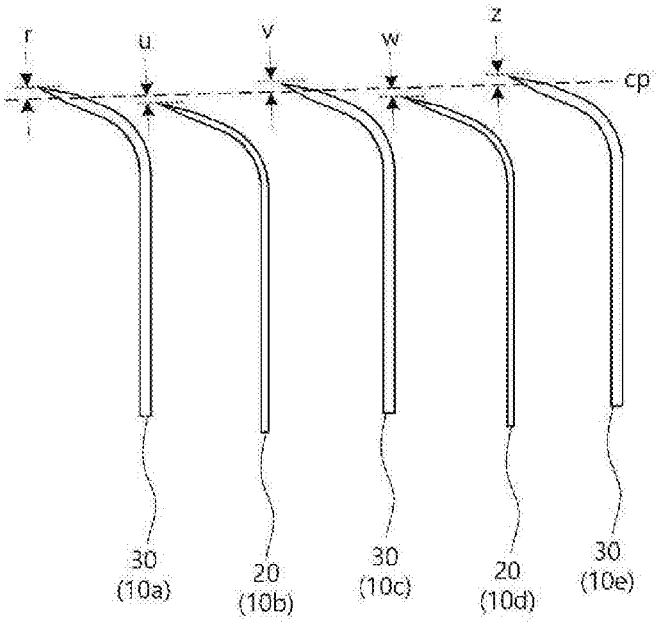

Next, FIGS. 9 and 10 are views showing an embodiment in which exposures of the blades are formed in a zigzag pattern with respect to the contact plane cp. Referring to FIGS. 9 and 10, thin and thick blades 20 and 30 are alternately arranged from the front to the back of the razor cartridge, and the positive and negative exposures thereof with respect to the contact plane cp are also alternately formed. In FIG. 9, a thin blade 20 is arranged first at the front. In contrast, in FIG. 10, a thick blade 30 is arranged first at the front. In any case, the exposure of the thick blades is positive and the exposure of the thin blades is negative.

When the thick and thin razor blades are alternately arranged to be adjacent to each other, the shaving characteristics of the thick blades and the shaving characteristics of the thin blades complement each other, and thus the overall shaving performance may be improved.

Figure 11:
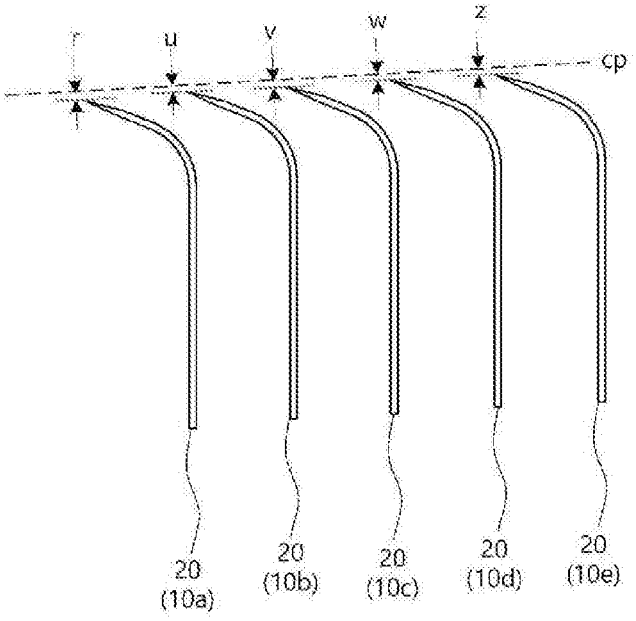
FIG. 11 is a view illustrating a case in which exposures of all blades with respect to a contact plane are negative.
Figure 12:
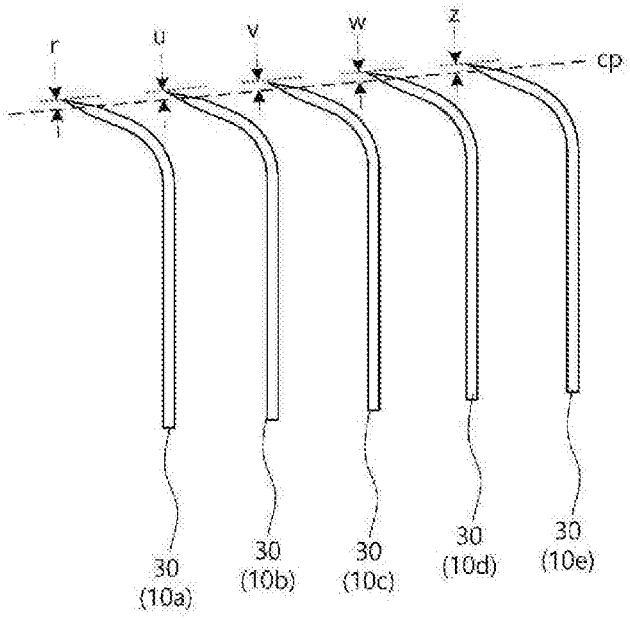
FIG. 12 is a view illustrating a case in which exposures of all blades with respect to a contact plane are positive.

Lastly, FIGS. 11 and 12 illustrate the case where the exposures of all blades with respect to the contact plane cp are negative or positive. FIG. 11 shows that the blades are all thin blades 20 and the tip edges thereof are below the contact plane cp (all negative). Such thin blades having negative exposures reduce skin irritation and enable shaving with low cutting resistance. While it is illustrated in the figure that the thin blades 20 have the same thicknesses and exposure, the present invention is not limited thereto. When the thin blades have different thicknesses, the blades may have different exposures.

In contrast with FIG. 11, FIG. 12 shows that the blades are all thick blades 30 and the tip edges thereof are over the contact plane cp (all positive). The thick blades having positive exposures provide increased durability along with larger cutting force in shaving. While it is illustrated in the figure that the thick blades have the same thicknesses and exposure, the present invention is not limited thereto. When the thick blades 30 have different thicknesses, the blades may have different exposures.

In any of the embodiments of FIGS. 7 to 12, the exposure and thickness T15 of the five blades may be selected so as to satisfy the numerical range of at least one of the above-described Equations 1 to 3. However, the number of razor blades is not limited to five, but may be reduced or increased from five.

In the above embodiments, the razor cartridge 100 has been described as having a single contact plane cp in which the blades 10 are arranged between the front guard 2 at the front and the cap 4 at the rear. However, the present invention is not limited thereto. The razor cartridge 110 may be provided with two contact planes cp1 and cp2 by forming an additional guard (intermediate guard, third contact member) between the front guard 2 and the rear cap 4. Thus, when an intermediate guard is additionally formed in the middle of the razor cartridge 110, shaving safety may be enhanced, nicks and cuts may be decreased, and close contact with the skin may also be enhanced.

Figure 13:
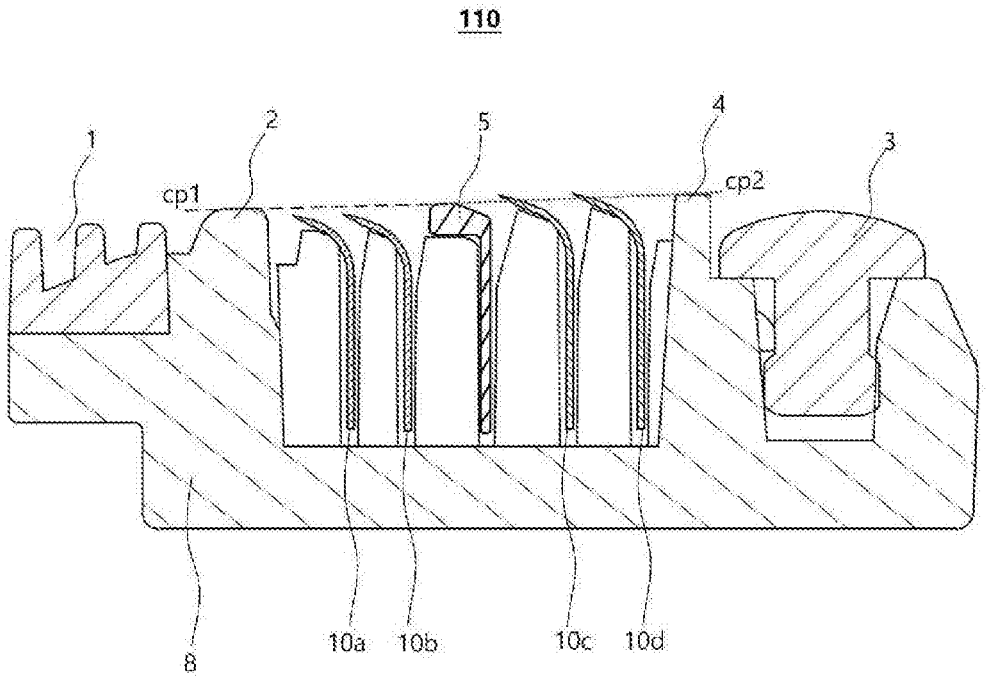
FIG. 13 is a cross-sectional view of a razor cartridge according to another embodiment of the present invention.

FIG. 13 is a cross-sectional view showing a razor cartridge 110 according to another embodiment of the present invention. Referring to FIG. 13, four blades 10*a* to 10*d* are arranged in the blade housing 8, and an intermediate guard 5 is provided between the two blades 10*a* and 10*b* in the front area and the two blades 10*c* and 10*b* in the rear area. As shown in the figure, the intermediate guard 5 may be mounted between the seating projections in a similar manner to mounting of the blades 10*a* to 10*d*. However, the present invention is not limited thereto. For example, the intermediate guard may be provided in the form of a partition wall integrated with the blade housing 8.

Thereby, the razor cartridge 110 has a first contact plane cp1 contacting the upper end of the front guard 2 at the front and upper end of the intermediate guard 5 and a second contact plane cp2 contacting the upper end of the intermediate guard 5 and the upper end of the cap 4 at the rear.

According to an embodiment exemplified in FIG. 13, the blades 10*a* and 10*b* arranged between the front guard 2 and the intermediate guard 5 are relatively thin blades (e.g., blades having T15 of 5.2±0.5 μm), and the blades 10*c* and 10*d* arranged between the intermediate guard 5 and the rear cap 4 are relatively thick blades (e.g., blades having T15 of 6.2±0.5 μm). In this case, the thin blades 10*a* and 10*b* in the front area have relatively low exposures, while the thick blades 10*c* and 10*d* in the rear area have relatively high exposures. For example, the exposures of the thin blades 10*a* and 10*b* are negative with respect to the first contact plane cp1, and the exposures of the thick blades 10*c* and 10*d* are positive with respect to the second contact plane cp2.

Thus, in actual shaving, primary cutting is performed by the thin blades, and then secondary cutting is performed by the thick blades. As a result, the thin blades in the front area may provide proper shaving with low cutting resistance while reducing skin irritation, and the thick blades 10*c* and 10*d* arranged behind may ensure sufficient support stiffness and durability.

According to another embodiment related to FIG. 13, the blades arranged in at least one of the front area and the rear area include a thin blade having a negative exposure with respect to contact plane cp1, cp2 corresponding to the area (e.g., a blade with T15 of 5.2±0.5 μm), and a thick blade having a higher exposure (e.g., a blade with T15 of 6.2±0.5 μm) than the exposure of the thin blade.

As a more specific example, the blades 10*a* and 10*b* in the front area may be arranged in order of a thin blade followed by a thick blade (or vice versa), or the blades 10*c* and 10*d* in the rear area may be arranged in order of a thin blade followed by a thick blade (or vice versa). Of course, in this case, it is preferable to arrange the blades such that the exposure of the thick blade is higher than the exposure of the thin blade. Thus, the exposure of the thick blade 10*b* is larger than the exposure of the thin blade 10*a* with respect to the first contact plane cp1. Similarly, the exposure of the thick blade 10*d* is larger than the exposure of the thin blade 10*c* with respect to the second contact plane cp2.

In the embodiment of FIG. 13, the exposures and thicknesses of the four blades at T15 may be selected so as to satisfy the numerical range of at least one of the above-mentioned Equations 1 to 3. In addition, the number of razor blades is not limited to four. Therefore, the number of blades in the front area and the number of blades in the rear area may be equally one or three or more. Alternatively, the number of blades in the front area may be different from the number of blades in the rear area.

In the foregoing, description has been given of embodiments in which a plurality of blades is designed and arranged considering that shaving performance varies depending on the correlation between the thickness and the exposure of the blades. The shaving performance may be further improved by additionally considering a correlation between the thickness and the span of the blades.

Figure 14:
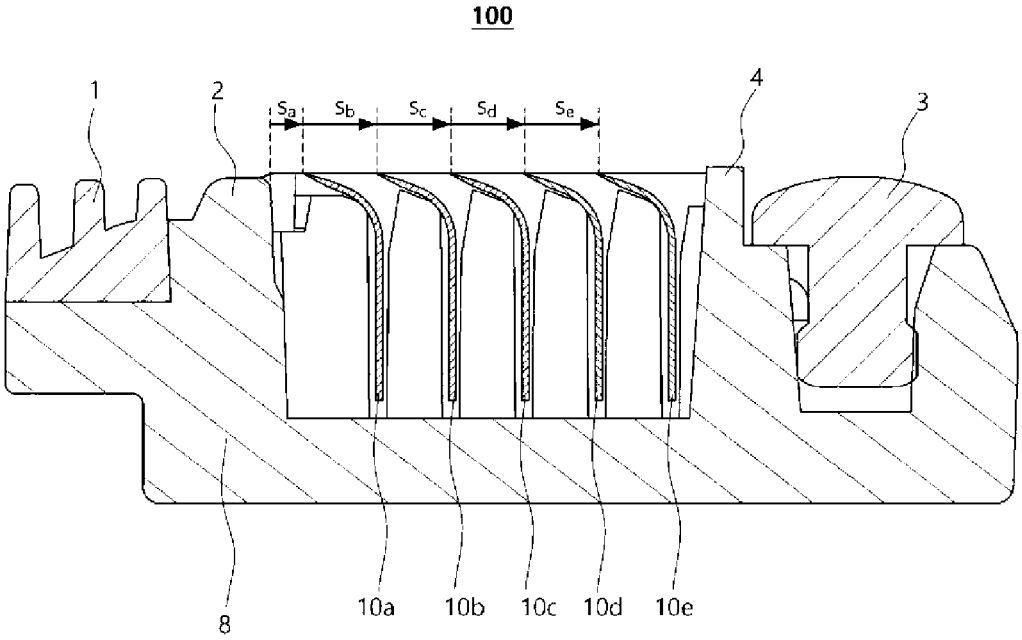
FIG. 14 is a view showing spans defined in a razor cartridge according to an embodiment of the present invention.

FIG. 14 is a view showing spans sa, sb, sc, sd, and se used as one of design variables in a typical razor cartridge. The spans for specific blades may differ from each other. A span may be defined as a horizontal distance between the tip edge of a preceding blade and the tip edge of a current blade. For the first blade 10*a*, which does not have a preceding blade, the span therefor is defined as a distance between the wall of the front guard 2 and the tip edge of the first blade 10*a*.

Generally, when the span is wide, it is advantageous for discharging shaving cream, moisture or shaving debris, but it leads to increase in size of the razor cartridge and easily causes cuts during shaving. When the span is narrow, the opposite effects are obtained. Therefore, it is important to select an appropriate span considering the shaving conditions, and the span also needs to be designed in accordance with the thickness of the blade. For example, the thin blade may be designed to have a relatively narrow span in order to reduce cuts of the skin, and the thick blade may be designed to have a relatively wide span in order to improve the discharge performance at the time of shaving. In particular, even if the thick blade has the same span as the thin blade, it may narrow the spacing between the preceding blades due to its own dimensions, and thus, the corresponding span needs to be widened.

In a razor cartridge according to the present invention, a relatively thin blade is arranged at a position where the exposure is negative to reduce skin irritation, and a relatively thick razor blade is arranged at a position where the exposure is positive. Thereby, shaving performance may be improved, and both shaving comfort and shaving efficiency may be improved.

Further, in the razor cartridge according to the present invention, a larger load is set to be applied to the thick blade having a positive exposure, thereby increasing the durability of the razor cartridge. Accordingly, both the performance maintenance period and the quality maintenance period can be increased.

While the embodiments of the present invention have been described with reference to the accompanying drawings, it should be understood by those skilled in the art that various modifications may be made without departing from the scope of the present invention and without changing essential features thereof. It is therefore to be understood that the embodiments described above are in all respects illustrative and not restrictive.

In addition, the dimensions and values disclosed herein are not to be understood as being strictly limited to the exact numerical values listed. Unless otherwise specified, each of such dimensions is intended to include both the enumerated value and a functionally equivalent range around that value.

What is claimed is:

1. A razor cartridge comprising:

a blade housing configured to accommodate a plurality of blades comprising at least a first blade and a second blade;

a first contact member arranged at a front side of the plurality of blades with respect to a shaving direction; and a second contact member arranged at a rear side of the plurality of blades with respect to the shaving direction, wherein both the first and second blades are monolithic blades or joined blades, wherein each of the first and second blades comprises an edge portion and a base, wherein the first blade has smaller thickness dimensions at positions along a tip edge located at a front end of the edge portion of the first blade compared to thickness dimensions at corresponding positions along a tip edge located at a front end of the edge portion of the second blade, wherein a first exposure amount of the first blade with respect to a contact plane defined between the first contact member and the second contact member is less than a second exposure amount of the second blade with respect to the contact plane, and wherein a cutting force of the first blade is lower than that of the second blade.

2. The razor cartridge according to claim 1, wherein the first exposure amount is negative with respect to the contact plane.

3. The razor cartridge according to claim 1, wherein the second exposure amount is positive with respect to the contact plane.

4. The razor cartridge according to claim 1, wherein the first exposure amount is greater than or equal to −0.1 mm.

5. The razor cartridge according to claim 1, wherein the second exposure amount is less than or equal to 0.1 mm.

6. The razor cartridge according to claim 1, wherein a shaving hair cutting force (SHCF) of the first blade is less than a SHCF of the second blade by at least 5%.

7. The razor cartridge according to claim 1, wherein the first blade and the second blade are positioned adjacent to each other among the plurality of blades.

8. The razor cartridge according to claim 1, wherein a span between the first blade and a next adjacent blade is different from a span between the second blade and another adjacent blade.

9. The razor cartridge according to claim 1, wherein:

a first position on the tip edge of the first blade and a second position on the tip edge of the second blade corresponding to the first position are spaced apart from a respective tip of the first blade and the second blade by 15 μm;

a thickness of the first blade at the first position is in a range of 4.7 μm to 5.7 μm; and a thickness of the second blade at the second position is in a range of 5.7 μm to 6.7 μm.

10. The razor cartridge according to claim 9, wherein when the thickness of the first blade at the first position is in 5.7 μm, the thickness of the second blade at the second position is greater than 5.7 μm.

11. The razor cartridge according to claim 1, further comprising a third contact member between the first contact member and the second contact member, wherein at least one of the plurality of blades is arranged between the first contact member and the third contact member and at least one of the plurality of blades is arranged between the third contact member and the second contact member.

12. The razor cartridge according to claim 1, wherein each of the plurality of blades further comprises a bent portion connecting the edge portion and the base.

13. The razor cartridge according to claim 1, wherein the first blade is located at a frontmost position among the plurality of blades with respect to the shaving direction and the second blade is located at a rearmost position among the plurality of blades with respect to the shaving direction.

14. The razor cartridge according to claim 1, wherein the plurality of blades are alternately arranged such that at least one thin blade is positioned between two relatively thick blades or at least one thick blade is positioned between two relatively thin blades.

15. The razor cartridge according to claim 14, wherein the at least one thin blade is located at a frontmost position among the plurality of blades with respect to the shaving direction.

16. The razor cartridge according to claim 14, wherein the at least one thick blade is located at a frontmost position among the plurality of blades with respect to the shaving direction.

17. The razor cartridge according to claim 1, wherein each of the monolithic blades includes the edge portion, the base, and a bent portion connecting the base and the edge portion such that the edge portion and the base do not overlap.

18. The razor cartridge according to claim 1, wherein each of the joined blades includes the edge portion that is joined to the base such that a portion of the edge portion and a portion of the base overlap.

19. The razor cartridge according to claim 18, wherein the base of the joined blade is thicker than the edge portion of the joined blade.

* * * * *